US011472514B2

(12) United States Patent
Park et al.

(10) Patent No.: US 11,472,514 B2
(45) Date of Patent: Oct. 18, 2022

(54) MEMBRANE TYPE INSULATION SYSTEM FOR CRYOGENIC LNG CARRIER CARGO TANK AND LIQUEFIED GAS FUEL CONTAINER

(71) Applicant: DAEWOO SHIPBUILDING & MARINE ENGINEERING CO., LTD., Geoje-si (KR)

(72) Inventors: Seong Woo Park, Geoje-Si (KR); Seung Min Kwon, Incheon (KR); Joong Kyoo Kang, Geoje-si (KR)

(73) Assignee: Daewoo Shipbuilding & Marine Engineering Co., Ltd., Geoje-si (KR)

( * ) Notice: Subject to any disclaimer, the term of this patent is extended or adjusted under 35 U.S.C. 154(b) by 0 days.

(21) Appl. No.: 16/621,095

(22) PCT Filed: Jan. 2, 2019

(86) PCT No.: PCT/KR2019/000007
§ 371 (c)(1),
(2) Date: Dec. 10, 2019

(87) PCT Pub. No.: WO2020/141619
PCT Pub. Date: Jul. 9, 2020

(65) Prior Publication Data

US 2021/0323642 A1 Oct. 21, 2021

(51) Int. Cl.
*B63B 25/16* (2006.01)
*B63B 25/08* (2006.01)
*F17C 3/02* (2006.01)

(52) U.S. Cl.
CPC ..... *B63B 25/16* (2013.01); *B63B 25/08* (2013.01); *F17C 3/027* (2013.01); (Continued)

(58) Field of Classification Search
CPC ..... B63B 17/00; B63B 25/00; B63B 25/08; B63B 25/16; F17C 3/02; F17C 3/027; (Continued)

(56) References Cited

U.S. PATENT DOCUMENTS 6,145,690 A * 11/2000 Dhellemmes ..... B63B 25/16 220/560.07
7,171,916 B2 * 2/2007 Yang ..... B63B 25/16 114/74 A
7,204,195 B2 * 4/2007 Yang ..... B63B 25/16 114/74 A

FOREIGN PATENT DOCUMENTS

KR 10-2001-0050440 A 6/2001
KR 10-2017-0050588 A 5/2017
(Continued)

OTHER PUBLICATIONS

International Search Report dated Sep. 26, 2019 in PCT/KR2019/000007 Filed Jan. 2, 2019 in 3 pages.

*Primary Examiner* — Lars A Olson
(74) *Attorney, Agent, or Firm* — Knobbe Martens Olson & Bear LLP

(57) ABSTRACT

Disclosed is a membrane type insulation system for LNG carrier cargo tank and liquefied gas fuel container wherein a corrugation finishing membrane formed of Invar steel is welded to a secondary membrane connecting portion or a primary membrane connecting portion in order to seal corrugations at a corner portion of a cargo tank in a structure wherein at least one of a primary membrane and a secondary membrane is formed of an SUS material having corrugations, thereby improving work efficiency while reducing manufacturing costs through elimination of a separate angled piece for connection between corrugations on adjacent walls at the corner portion.

17 Claims, 4 Drawing Sheets

1

(52) U.S. Cl.
CPC ... *B63B 2025/085* (2013.01); *F17C 2203/012* (2013.01); *F17C 2203/032* (2013.01); *F17C 2203/0358* (2013.01); *F17C 2221/033* (2013.01); *F17C 2270/0107* (2013.01)

(58) Field of Classification Search
CPC ..... F17C 2203/012; F17C 2203/032; F17C 2203/0358; F17C 2221/033; F17C 2270/0107; F17C 13/00
USPC ..... 114/74 A
See application file for complete search history.

(56) References Cited

FOREIGN PATENT DOCUMENTS

| | | | |
|---|---|---|---|
| KR | 10-2018-0006113 | A | 1/2018 |
| KR | 10-2018-0061945 | A | 6/2018 |
| KR | 10-2018-0092402 | A | 8/2018 |
| KR | 10-2019-0075545 | A | 7/2019 |

* cited by examiner

【FIG. 1】
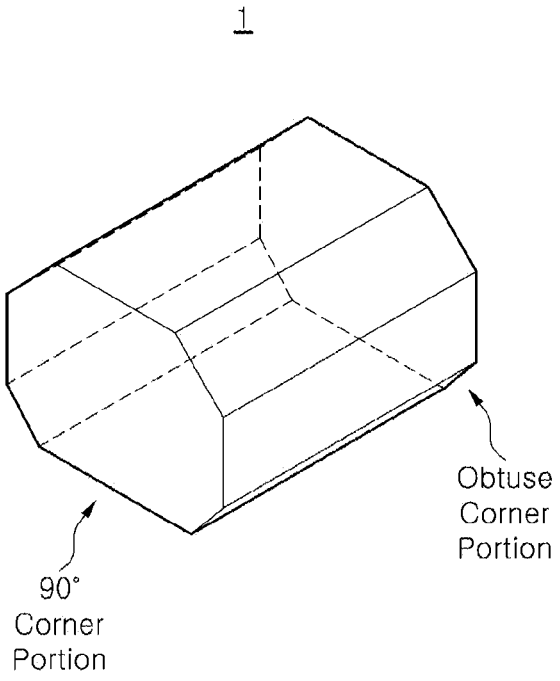
【FIG. 2】
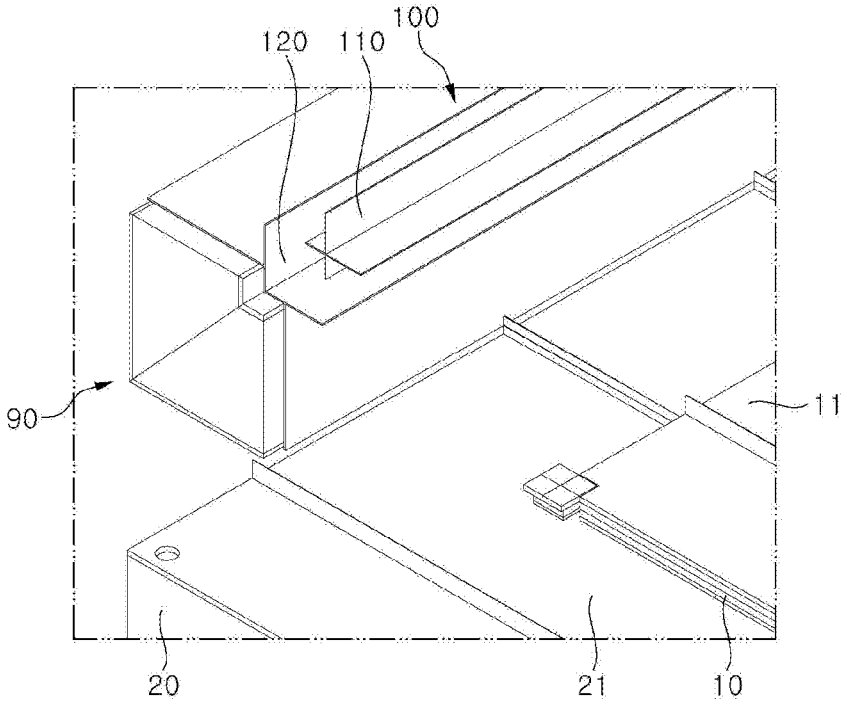

【FIG. 3】
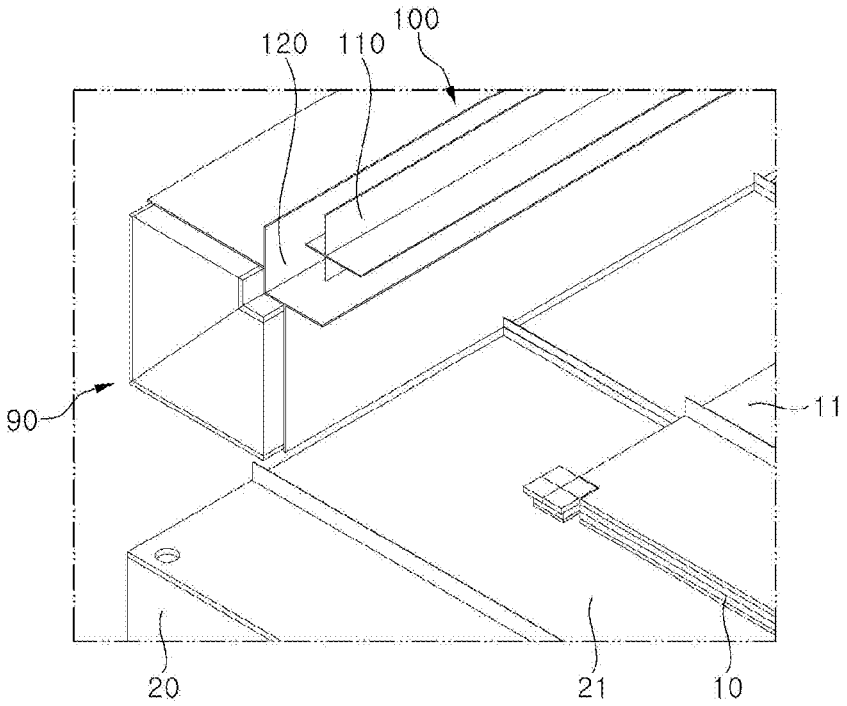
【FIG. 4】
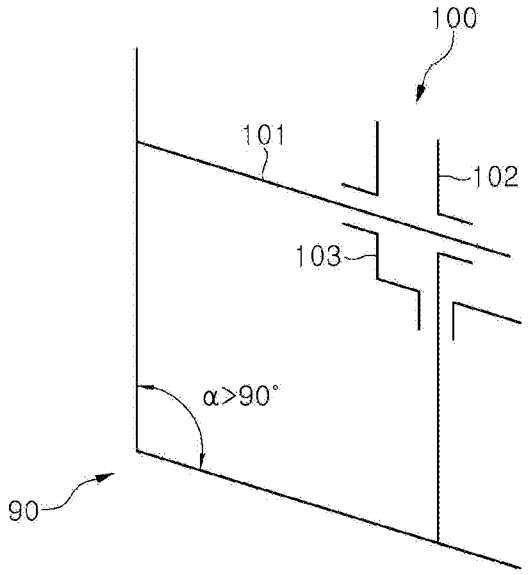

【FIG. 5】
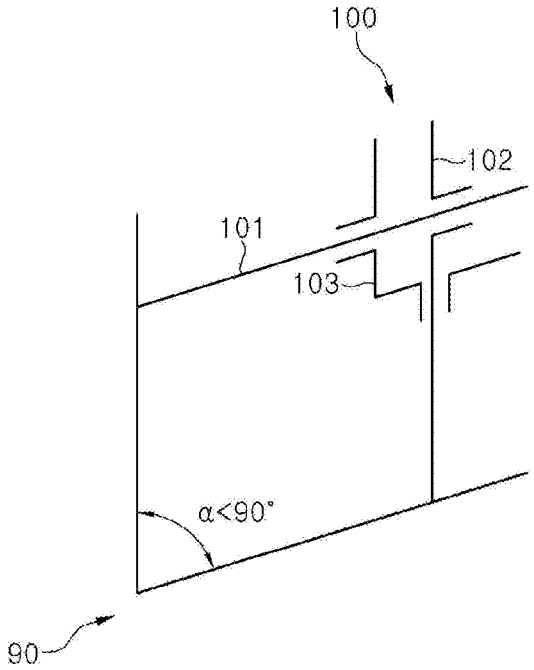
【FIG. 6】
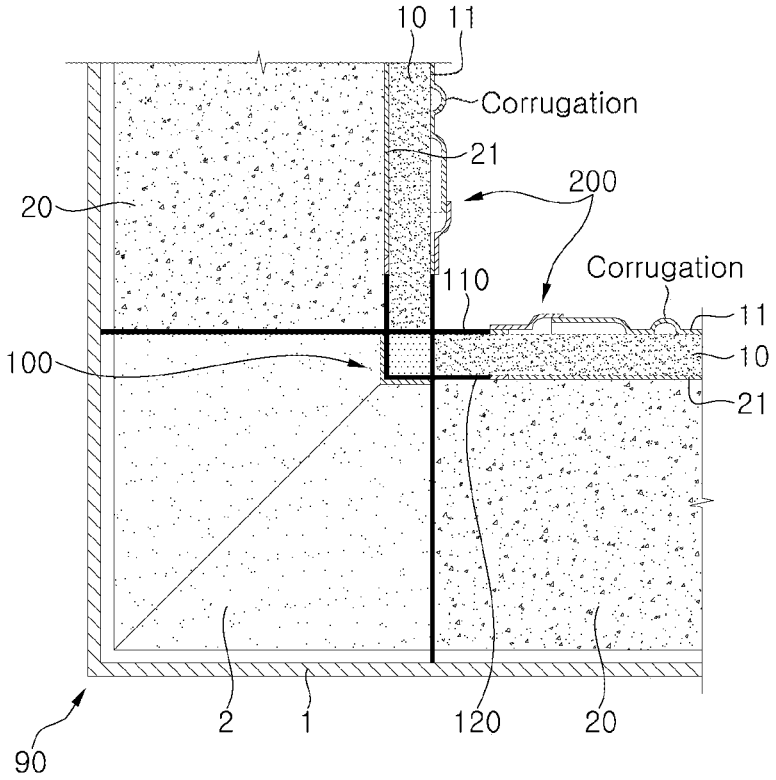

【FIG. 7】
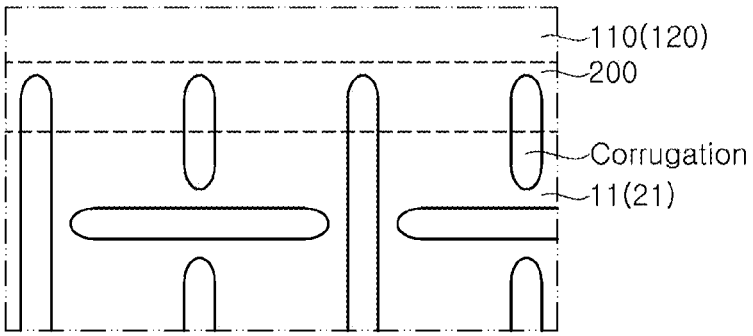
【FIG. 8】
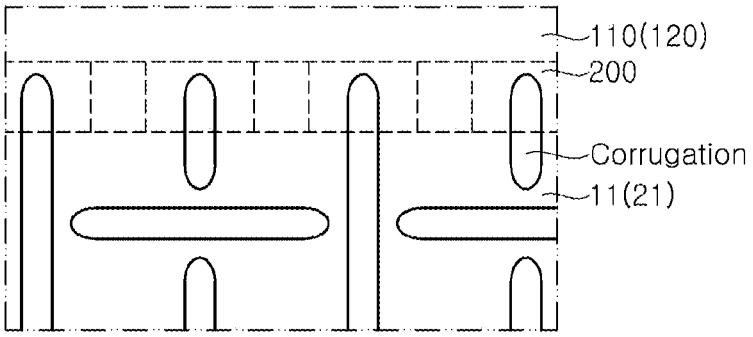

MEMBRANE TYPE INSULATION SYSTEM FOR CRYOGENIC LNG CARRIER CARGO TANK AND LIQUEFIED GAS FUEL CONTAINER

TECHNICAL FIELD

The present invention relates to a membrane type insulation system for cryogenic LNG carrier cargo tank and liquefied gas fuel container, and more particularly, to a membrane type insulation system for cryogenic LNG carrier cargo tank and liquefied gas fuel container, which has a thermal insulation structure capable of implementing a barrier even without connection between corrugations of primary/secondary membranes at corners between two adjacent surfaces of the cargo tank.

BACKGROUND ART

Generally, liquefied natural gas (LNG) is a colorless and transparent cryogenic liquid obtained by cooling natural gas mainly consisting of methane to about −163° C. to have a volume of about 1/600 that of natural gas. Thus, liquefaction of natural gas enables very efficient storage and transportation.

An LNG carrier is used to transport large amounts of LNG from a production base to a demand site to use LNG as an energy source.

The LNG carrier stores natural gas in a storage tank (cargo tank) after liquefaction of the natural gas into cryogenic LNG at a loading port corresponding to a production base and supplies natural gas to a demand site or consumers through pipelines after vaporization of the cryogenic LNG into the natural gas at an unloading port.

Storage tanks for storing liquefied gas such as LNG and the like are classified into an independent type and a membrane type depending upon whether load of a cargo is directly applied to a heat insulator of the storage tank.

Typically, the membrane type storage tank is divided into a GTT NO 96-type and a TGZ Mark III-type, and the independent type storage tank is divided into an MOSS-type and an IHI-SPB-type.

A conventional membrane type insulation system of an LNG carrier cargo tank includes an insulation box at a corner portion of the cargo tank to transfer load of the cargo tank from the corner portion to an inner wall of a hull; and an Invar tube structure adapted to transfer load of the cargo tank from the corner portion to the inner wall of the hull. An angled piece is provided to adjacent walls at the corner portion of the cargo tank and is connected to membranes to seal the membranes.

However, in the conventional membrane type insulation system, sealing treatment of the membranes performed by installing the angle piece on the adjacent walls at the corner portion of the cargo tank is very difficult, causing deterioration in work efficiency and increase in manufacturing costs.

DISCLOSURE

Technical Problem

Embodiments of the present invention provide a membrane type insulation system for cryogenic LNG carrier cargo tank and liquefied gas fuel container, in which a corrugation finishing membrane formed of Invar steel is directly welded to a secondary membrane connecting portion or a primary membrane connecting portion in order to seal corrugations (distal ends of membranes) at a corner portion of a cargo tank in a structure wherein at least one of a primary membrane and a secondary membrane is formed of an SUS material having corrugations thereon, thereby improving work efficiency while reducing manufacturing costs through elimination of a separate angled piece for connection between corrugations on adjacent walls at the corner portion.

Technical Solution

In accordance with one aspect of the present invention, there is provided a membrane type insulation system for LNG carrier cargo tank and liquefied gas fuel container, wherein a corrugation finishing membrane of Invar steel is connected to at least one of a secondary membrane connecting portion and a primary membrane connecting portion to seal corrugations at a corner portion of a cargo tank in a dual metal barrier structure including a primary membrane and a secondary membrane in which at least one of the primary membrane and the secondary membrane is formed of an SUS material having corrugations thereon.

In accordance with another aspect of the present invention, there is provided a membrane type insulation system for LNG carrier cargo tank and liquefied gas fuel container, the membrane type insulation system including: an Invar tube structure having a secondary membrane connecting portion and a primary membrane connecting portion to transfer load of a cargo tank from a corner portion of the cargo tank to an inner wall of a hull; a secondary membrane connected to the secondary membrane connecting portion; a primary membrane connected to the primary membrane connecting portion; and a corrugation finishing membrane of Invar steel connected to the secondary membrane connecting portion or the primary membrane connecting portion to seal corrugations at the corner portion in a structure wherein at least one of the primary membrane and the secondary membrane is formed of an SUS material having corrugations thereon.

The primary membrane and the secondary membrane may be a flat type membrane or a corrugation type membrane.

For example, the primary membrane may be a flat type membrane and the secondary membrane may be a corrugation type membrane. Alternatively, the primary membrane may be a corrugation type membrane and the secondary membrane may be a flat type membrane.

The corrugation finishing membrane may be connected to the primary membrane connecting portion or the secondary membrane connecting portion to seal the corrugations, thereby forming a barrier structure without an angled piece on adjacent walls at the corner portion.

The corner portion may include a 90° corner portion, an obtuse corner portion, and an acute corner portion.

In accordance with a further aspect of the present invention, there is provided a membrane type insulation system for LNG carrier cargo tank and liquefied gas fuel container, the membrane type insulation system including: an insulation box disposed at a corner portion of a cargo tank; an Invar tube structure comprising a secondary membrane connecting portion and a primary membrane connecting portion to transfer load of the cargo tank from the corner portion to an inner wall of a hull; a secondary insulation panel disposed on the inner wall of the hull; a secondary membrane disposed on the secondary insulation panel and connected to the secondary membrane connecting portion; a primary insulation panel disposed on the secondary membrane; a primary membrane disposed on the primary insulation panel and connected to the primary membrane connecting portion; and a corrugation finishing membrane of Invar steel connected to the secondary membrane connecting portion or the primary membrane connecting portion to seal corrugations at the corner portion in a structure wherein at least one of the primary membrane and the secondary membrane is formed of an SUS material having corrugations thereon.

Advantageous Effects

As described above, conventionally, in a structure wherein a primary membrane and a secondary membrane are formed of an SUS material having corrugations (at distal ends of the membranes) on adjacent walls at a corner portion of a cargo tank, a separate angled piece is welded to the membranes to connect the corrugations on the adjacent walls at the corner portion. On the contrary, according to embodiments of the present invention, a corrugation finishing membrane formed of Invar steel is directly welded to a secondary membrane connecting portion or a primary membrane connecting portion to seal the corrugations at the corner portion of the cargo tank, thereby eliminating a need for welding of a separate angled piece.

That is, according to the embodiments of the invention, in the structure wherein at least one of the primary membrane and the secondary membrane is formed of an SUS material having corrugations thereon, the corrugation finishing membrane formed of Invar steel is directly welded to the secondary membrane connecting portion or the primary membrane connecting portion to seal the corrugations at the corner portion of the cargo tank, thereby implementing sealing operation without welding of a separate angled piece for connection between the corrugations on the adjacent walls at the corner portion.

Typically, since the membrane type insulation system generally applied to a cargo tank of a large LNG carrier is suitable for walls of the cargo tank having a standard shape and size, on which the insulation system is installed, complexity of the corner portion of the membrane type insulation system increases upon installation of the membrane type insulation system on walls of a cargo tank having a non-standard or non-general shape. However, the membrane type insulation system according to the present invention may be applied to both a flat type membrane and a corrugation type membrane and to any corner portions having a right angle, an obtuse angle, and an acute angle, thereby maximizing space utilization.

In particular, for the corrugation type membrane, the corrugation finishing membrane formed of Invar steel may be directly welded to a membrane connecting portion of an Invar tube structure as in this embodiment, thereby securing sufficient sealing of the membrane even without a structure for connection of corrugations on two adjacent surfaces at a corner portion of the cargo tank.

In addition, a typical insulation system suffers from thermal loss due to an Invar tube structure of a metallic material, whereas the insulation system according to the embodiments of the invention can minimize thermal loss using a box type insulator and/or a panel type insulator acting as a structural member disposed inside the Invar tube structure.

DESCRIPTION OF DRAWINGS

FIG. 1 is a perspective view of a cryogenic LNG carrier cargo tank and liquefied gas fuel container according to the present invention.

FIG. 2 is a perspective view of a 90° corner portion of the cryogenic LNG carrier cargo tank and liquefied gas fuel container according to the present invention.

FIG. 3 is a perspective view of the 90° corner portion and an obtuse corner portion of the cryogenic LNG carrier cargo tank and liquefied gas fuel container according to the present invention.

FIG. 4 is a sectional view of an Invar tube structure at an obtuse corner portion of a cargo tank.

FIG. 5 is a sectional view of an Invar tube structure at an acute corner portion of the cargo tank.

FIG. 6 is a longitudinal perspective view of a 90° corner portion of a cargo tank in a membrane type insulation system for cryogenic LNG carrier cargo tank and liquefied gas fuel container according to the present invention.

FIG. 7 is a plan view of a welded structure between a monolithic type corrugation finishing membrane of Invar steel and a membrane connecting portion.

FIG. 8 is a plan view of a welded structure between a composite type corrugation finishing membrane of Invar steel and a membrane connecting portion.

BEST MODE

Hereinafter, embodiments of the present invention will be described in detail with reference to the accompanying drawings.

FIG. 1 is a perspective view of a cryogenic LNG carrier cargo tank and liquefied gas fuel container according to the present invention, FIG. 2 is a perspective view of a cryogenic LNG carrier cargo tank and liquefied gas fuel container according to the present invention, and FIG. 3 is a perspective view of the 90° corner portion and an obtuse corner portion of the cryogenic LNG carrier cargo tank and liquefied gas fuel container according to the present invention.

Referring to these drawings, this embodiment relates to a structure for connecting corrugations on membranes at a corner portion, which is applicable to an installation space of an insulation system for a storage tank having various shapes and implements a barrier at the corner portion defined between two surfaces without additional connection of an angled piece thereto in a structure wherein a primary membrane 11 and/or a secondary membrane 21 are formed of an SUS material and include corrugations thereon.

That is, an Invar tube structure 100 formed of Invar steel exhibiting relatively little thermal shrinkage is provided to all corner portions of the installation space of the insulation system. The Invar tube structure 100 includes a primary membrane connecting portion 110 and a secondary membrane connecting portion 120 connected to the primary membrane 11 and the secondary membrane 21, respectively. The corner portions 90 may include a 90° corner portion and an obtuse corner portion of a cargo tank 1 (see FIG. 1).

Although the Invar tube structure according to this embodiment can be applied to any structure wherein at least one of the primary membrane 11 and the secondary membrane 21 is formed of an SUS material having corrugations thereon, the following description will focus on a structure wherein the corrugations are formed on the primary membrane 11 for convenience of description.

The Invar tube structure 100 includes a insulator serving as a box-shaped or panel-shaped insulating member, that is, an insulation box 2, to secure thermal insulation and structural stability, and may be applied to LNG carrier cargo tank or liquefied gas fuel container having various shapes without design change.

Although not shown in the drawings, in a membrane type insulation system for cryogenic LNG carrier cargo tank and liquefied gas fuel container according to the present invention, metal membranes capable of being used under cryogenic conditions are used as the primary and secondary membranes; a primary insulation layer may be composed of a composite of plywood, a heat insulator and a composite material, and have a thickness set to 20% to 30% of a thickness of the secondary insulation layer; and a secondary insulation layer may have a sandwich structure of glass fiber-reinforced polyurethane foam and plywood (or plywood and a composite material).

Specifically, the primary insulation panel 10 may be formed to a thickness set to 30% or less, preferably 10% to 20%, of the thickness of the secondary insulation panel 20, and may have a monolithic structure in which plural plywood sheets are stacked in a thickness direction thereof, or a composite structure of plural plywood sheets and a heat insulator, for example, glass wool or low density polyurethane foam having a density of 40 kg/m$^3$ to 50 kg/m$^3$.

According to the present invention, the thickness of the primary insulation panel is set to 30% or less of the thickness of the secondary insulation panel and the primary insulation panel having the monolithic structure or the composite structure is suitably disposed at an interior installation location of the cargo tank depending upon load of liquefied gas which the cargo tank can sustain, thereby realizing weight reduction and slimness while significantly reducing manufacturing costs through improvement in thermal insulation and structural rigidity and simplification of a process of manufacturing a cargo tank.

Next, the membrane type insulation system for cryogenic LNG carrier cargo tank and liquefied gas fuel container according to the present invention will be described in more detail.

FIG. 4 is a sectional view of an Invar tube structure at an obtuse corner portion of a cargo tank, FIG. 5 is a sectional view of an Invar tube structure at an acute corner portion of a cargo tank, and FIG. 6 is a longitudinal perspective view of a 90° corner portion of a cargo tank in a membrane type insulation system for cryogenic LNG carrier cargo tank and liquefied gas fuel container according to the present invention.

As shown in these drawings, the membrane type insulation system for cryogenic LNG carrier cargo tank and liquefied gas fuel container according to embodiments of the present invention include an insulation box 2 disposed at a corner portion 90 of a cargo tank to transfer load of the cargo tank to an inner wall 1 of a hull; and an Invar tube structure 100 including a secondary membrane connecting portion 120 and a primary membrane connecting portion 110 to transfer the load of the cargo tank from the corner portion 90 to the inner wall 1 of the hull.

The corner portion of the cargo tank may include a 90° corner portion, an obtuse corner portion, and an acute corner portion depending upon angle (a) thereof. As shown in FIG. 4 and FIG. 5, the Invar tube structure 100 disposed at the corner portion 90 of the cargo tank may be formed by welding, for example, seam welding, four primary bent members 102 and one tertiary bent member 103 with reference to a non-bent member 101. The tertiary bent member 103 is welded at one end thereof to the non-bent member 101 and at the other end thereof to the primary bent members 102 to form a lattice-shaped Invar tube space.

The secondary insulation panel 20 is disposed on the inner wall 1 of the hull and the secondary membrane 21 is disposed on the secondary insulation panel 20 to be connected to the secondary membrane connecting portion 120 by welding or the like.

The primary insulation panel 10 is disposed at a liquefied gas side, that is, on the secondary membrane 21, and the primary membrane 11 is disposed on the primary insulation panel 10 to be connected to the primary membrane connecting portion 110 by welding or the like.

According to the embodiments of the invention, the membrane type insulation system includes a corrugation finishing membrane 200 formed of Invar steel and connected to the secondary membrane connecting portion 120 or the primary membrane connecting portion 110 to seal the corrugations at the corner portion 90 in a structure wherein at least one of the primary membrane 11 and the secondary membrane 21 is formed of an SUS material having corrugations thereon.

Conventionally, in the structure wherein at least one of the primary membrane 11 and the secondary membrane 21 is formed of the SUS material having corrugations thereon, a separate angled piece is welded to the membranes to connect the corrugations on adjacent walls at the corner portion. However, the membrane type insulation system according to the embodiments of the invention does not require welding of a separate angled piece.

That is, according to the embodiments of the invention, in the structure wherein at least one of the primary membrane 11 and the secondary membrane 21 is formed of the SUS material having corrugations thereon, the corrugation finishing membrane 200 formed of Invar steel is directly welded to the secondary membrane connecting portion 120 or the primary membrane connecting portion 110 to seal the corrugations at the corner portion 90, thereby eliminating a need for a separate angled piece for connection between the corrugations on the adjacent walls at the corner portion.

The corrugation finishing membrane 200 formed of Invar steel may be welded to the secondary membrane connecting portion 120 or the primary membrane connecting portion 110 through seam welding and the like.

Next, operation of the membrane type insulation system for cryogenic LNG carrier cargo tank and liquefied gas fuel container according to the embodiments of the present invention will be described.

FIG. 6 is a longitudinal perspective view of a 90° corner portion of the cargo tank in the membrane type insulation system for cryogenic LNG carrier cargo tank and liquefied gas fuel container according to the present invention.

Referring to FIG. 6, according to the embodiments of the invention, in the structure wherein at least one of the primary membrane 11 and the secondary membrane 21 is formed of the SUS material having corrugations thereon, the corrugation finishing membrane 200 formed of Invar steel is welded to the secondary membrane connecting portion 120 or the primary membrane connecting portion 110 to seal the corrugations at the corner portion 90.

Conventionally, in the structure wherein at least one of the primary membrane 11 and the secondary membrane 21 is formed of the SUS material having corrugations thereon, a separate angled piece is welded to the membranes to connect the corrugations at adjacent walls of the corner portion. However, the membrane type insulation system according to the embodiments of the invention does not require welding of a separate angled piece.

That is, according to the embodiments of the invention, in the structure wherein at least one of the primary membrane 11 and the secondary membrane 21 is formed of the SUS material having corrugations thereon, the corrugation finishing membrane 200 formed of Invar steel is welded to the secondary membrane connecting portion 120 or the primary membrane connecting portion 110 to seal the corrugations at the corner portion 90, thereby eliminating a need for a separate angled piece for connection between the corrugations on the adjacent walls at the corner portion.

FIG. 7 is a plan view of a welded structure between a monolithic type corrugation finishing membrane of Invar steel and a membrane connecting portion of Invar steel, in which, in the structure wherein at least one of the primary membrane 11 and the secondary membrane 21 is formed of the SUS material having corrugations thereon, a monolithic type corrugation finishing membrane 200 formed of Invar steel is welded to the secondary membrane connecting portion 120 or the primary membrane connecting portion 110 to seal the corrugations at the corner portion 90 of the cargo tank, thereby eliminating a need for a separate angled piece for connection between the corrugations on the adjacent walls at the corner portion 90.

FIG. 8 is a plan view of a welded structure between a composite type corrugation finishing membrane of Invar steel and a membrane connecting portion of Invar steel. Here, in the structure wherein at least one of the primary membrane 11 and the secondary membrane 21 is formed of the SUS material having corrugations thereon, a composite type corrugation finishing membrane 200 formed of Invar steel is welded to the secondary membrane connecting portion 120 or the primary membrane connecting portion 110 to seal the corrugations at the corner portion 90 of the cargo tank, thereby eliminating a need for a separate angled piece for connection between the corrugations on the adjacent walls at the corner portion 90.

As described above, conventionally, in the structure wherein at least one of the primary membrane and the secondary membrane is formed of an SUS material having corrugations thereon, a separate angled piece is welded to the membranes to connect the corrugations on the membranes at the adjacent walls at the corner portion of the cargo tank. On the contrary, according to the embodiments of the invention, the corrugation finishing membrane formed of Invar steel is directly welded to the secondary membrane connecting portion or the primary membrane connecting portion to seal the corrugations at the corner portion of the cargo tank, thereby eliminating a need for welding of a separate angled piece.

That is, according to the embodiments of the invention, in the structure wherein at least one of the primary membrane and the secondary membrane is formed of an SUS material having corrugations thereon, the corrugation finishing membrane formed of Invar steel is directly welded to the secondary membrane connecting portion or the primary membrane connecting portion to seal the corrugations at the corner portion of the cargo tank, thereby eliminating a need for a separate angled piece for connection between the corrugations on the adjacent walls at the corner portion.

Since the membrane type insulation system generally applied to a cargo tank of a large LNG carrier is suitable for walls of the cargo tank having a standard shape and size, on which the insulation system is installed, complexity of the corner portion of the membrane type insulation system increases upon installation of the membrane type insulation system on walls of a cargo tank having a non-standard or non-general shape. However, the membrane type insulation system according to the present invention may be applied to both a flat type membrane and a corrugation type membrane and to any corner portions having a right angle, an obtuse angle, and an acute angle, thereby maximizing space utilization.

In particular, for the corrugation type membrane, the corrugation finishing membrane formed of Invar steel may be directly welded to a membrane connecting portion of an Invar tube structure as in this embodiment, thereby securing sufficient sealing of the membrane even without a structure for connection of corrugations on two adjacent surfaces at a corner portion of the cargo tank.

In addition, a typical insulation system suffers from thermal loss due to an Invar tube structure of a metallic material, whereas the insulation system according to the embodiments of the invention can minimize thermal loss using a box type insulator and/or a panel type insulator acting as a structural member disposed inside the Invar tube structure.

The invention claimed is:

1. A membrane type insulation system for LNG carrier cargo tank and liquefied gas fuel container, the membrane type insulation system comprising:

at least a first membrane formed of an SUS material having one or more corrugations;

an Invar tube structure having at least a first membrane connecting portion configured to transfer load of a cargo tank from a corner portion of the cargo tank to an inner wall of a hull; and a corrugation finishing membrane of Invar steel connected to both of the first membrane connecting portion and the first membrane, such that the corrugation finishing membrane seals a gap between the first membrane connecting portion and the one or more corrugations of the first membrane.

2. The membrane type insulation system according to claim 1, further comprising a second membrane, wherein the second membrane is one of a flat type membrane or a corrugation type membrane.

3. The membrane type insulation system according to claim 1, wherein the corrugation finishing membrane is connected to the first membrane connecting portion to seal the one or more corrugations without an angled piece on adjacent walls at the corner portion.

4. A membrane type insulation system for LNG carrier cargo tank and liquefied gas fuel container, the membrane type insulation system comprising:

an insulation box disposed at a corner portion of a cargo tank;

an Invar tube structure comprising a first membrane connecting portion and a second membrane connecting portion configured to transfer load of the cargo tank from the corner portion to an inner wall of a hull;

a first insulation panel disposed on the inner wall of the hull;

a first membrane disposed on the first insulation panel, connected to the first membrane connecting portion, and formed of an SUS material having one or more corrugations;

a second insulation panel disposed on the first membrane;

a second membrane disposed on the second insulation panel and connected to the second membrane connecting portion; and a corrugation finishing membrane of Invar steel connected to both of the first membrane connecting portion and the first membrane, such that the corrugation finishing membrane seals a gap between the first membrane connecting portion and the one or more corrugations of the first membrane.

5. The membrane type insulation system according to claim 4, wherein the corner portion comprises a 90° corner portion, an obtuse corner portion, and an acute corner portion.

6. The membrane type insulation system according to claim 1, further comprising a second membrane, wherein the Invar tube structure further comprises a second membrane connection portion connected to the second membrane.

7. The membrane type insulation system according to claim 1, wherein the gap comprises a height gap between (i) a portion of the first membrane connecting portion connected to the corrugation finishing membrane and (ii) a portion of the one or more corrugations of the first membrane connected to the corrugation finishing membrane, along a thickness direction perpendicular to a planar surface of the first membrane connecting portion.

8. The membrane type insulation system according to claim 1, wherein the gap comprises a width gap between (i) a portion of the first membrane connecting portion connected to the corrugation finishing membrane and (ii) a portion of the one or more corrugations of the first membrane connected to the corrugation finishing membrane, along a width direction perpendicular to both of (a) a thickness direction perpendicular to a planar surface of the first membrane connecting portion and (b) a leading edge of the first membrane connecting portion that is closest to the first membrane.

9. The membrane type insulation system according to claim 8, wherein the first membrane connecting portion and the corrugation finishing membrane overlap in the width direction.

10. The membrane type insulation system according to claim 8, wherein the first membrane and the corrugation finishing membrane overlap in the width direction.

11. The membrane type insulation system according to claim 4, wherein the gap comprises a height gap between (i) a portion of the first membrane connecting portion connected to the corrugation finishing membrane and (ii) a portion of the one or more corrugations of the first membrane connected to the corrugation finishing membrane, along a thickness direction perpendicular to a planar surface of the first membrane connecting portion.

12. The membrane type insulation system according to claim 4, wherein the gap comprises a width gap between (i) a portion of the first membrane connecting portion connected to the corrugation finishing membrane and (ii) a portion of the one or more corrugations of the first membrane connected to the corrugation finishing membrane, along a width direction perpendicular to both of (a) a thickness direction perpendicular to a planar surface of the first membrane connecting portion and (b) a leading edge of the first membrane connecting portion that is closest to the first membrane.

13. The membrane type insulation system according to claim 12, wherein the first membrane connecting portion and the corrugation finishing membrane overlap in the width direction.

14. The membrane type insulation system according to claim 12, wherein the first membrane and the corrugation finishing membrane overlap in the width direction.

15. A membrane type insulation system for LNG carrier cargo tank and liquefied gas fuel container, wherein a corrugation finishing membrane of Invar steel is connected to both of a first membrane connecting portion and a first membrane such that the corrugation finishing membrane seals a gap between the first membrane connecting portion and one or more corrugations of the first membrane, wherein the gap comprises a height gap between (i) a portion of the first membrane connecting portion connected to the corrugation finishing membrane and (ii) a portion of the one or more corrugations of the first membrane connected to the corrugation finishing membrane, along a thickness direction perpendicular to a planar surface of the first membrane connecting portion.

16. A membrane type insulation system for LNG carrier cargo tank and liquefied gas fuel container, wherein a corrugation finishing membrane of Invar steel is connected to both of a first membrane connecting portion and a first membrane such that the corrugation finishing membrane seals a gap between the first membrane connecting portion and one or more corrugations of the first membrane, wherein the gap comprises a width gap between (i) a portion of the first membrane connecting portion connected to the corrugation finishing membrane and (ii) a portion of the one or more corrugations of the first membrane connected to the corrugation finishing membrane, along a width direction perpendicular to both of (a) a thickness direction perpendicular to a planar surface of the first membrane connecting portion and (b) a leading edge of the first membrane connecting portion that is closest to the first membrane, wherein the first membrane connecting portion and the corrugation finishing membrane overlap in the width direction.

17. A membrane type insulation system for LNG carrier cargo tank and liquefied gas fuel container, wherein a corrugation finishing membrane of Invar steel is connected to both of a first membrane connecting portion and a first membrane such that the corrugation finishing membrane seals a gap between the first membrane connecting portion and one or more corrugations of the first membrane, wherein the gap comprises a width gap between (i) a portion of the first membrane connecting portion connected to the corrugation finishing membrane and (ii) a portion of the one or more corrugations of the first membrane connected to the corrugation finishing membrane, along a width direction perpendicular to both of (a) a thickness direction perpendicular to a planar surface of the first membrane connecting portion and (b) a leading edge of the first membrane connecting portion that is closest to the first membrane, wherein the first membrane and the corrugation finishing membrane overlap in the width direction.

* * * * *